US012577033B2

(12) United States Patent
de Lesseux et al.

(10) Patent No.: US 12,577,033 B2
(45) Date of Patent: Mar. 17, 2026

(54) REPULPABLE INSULATING LINERS, BAGS, AND MAILERS, AND METHODS OF MAKING AND USING THE SAME

(71) Applicant: COLDKEEPERS, LLC, Thomasville, GA (US)

(72) Inventors: Lionel de Bazelaire de Lesseux, Valdosta, GA (US); Langdon Strong Flowers, III, Thomasville, GA (US); Baudouin de Bazelaire de Lesseux, Valdosta, GA (US)

(73) Assignee: COLDKEEPERS, LLC, Thomasville, GA (US)

( * ) Notice: Subject to any disclaimer, the term of this patent is extended or adjusted under 35 U.S.C. 154(b) by 60 days.

(21) Appl. No.: 18/561,813

(22) PCT Filed: May 9, 2022

(86) PCT No.: PCT/US2022/028263

§ 371 (c)(1),
(2) Date: Nov. 17, 2023

(87) PCT Pub. No.: WO2022/245561

PCT Pub. Date: Nov. 24, 2022

(65) Prior Publication Data

US 2024/0239591 A1 Jul. 18, 2024

Related U.S. Application Data

(60) Provisional application No. 63/190,965, filed on May 20, 2021.

(51) Int. Cl.

| | |
|---|---|
| ***B65D 81/38*** | (2006.01) |
| ***B65D 25/16*** | (2006.01) |
| ***B65D 65/38*** | (2006.01) |

(52) U.S. Cl.
CPC ..... *B65D 81/3897* (2013.01); *B65D 25/16* (2013.01); *B65D 65/38* (2013.01); *B65D 81/3858* (2013.01); *B65D 2565/382* (2013.01)

(58) Field of Classification Search
CPC ..... B65D 81/3888; B65D 75/008; B65D 33/008; B65D 81/3897; B65D 25/16; B65D 65/38; B65D 81/3858; B65D 2565/382
See application file for complete search history.

(56) References Cited

U.S. PATENT DOCUMENTS

2010/0006630 A1* 1/2010 Humphries ..... B32B 15/085 428/116
2012/0243808 A1 9/2012 de Lesseux
(Continued)

FOREIGN PATENT DOCUMENTS

CN 110921042 A 3/2020
DE 202019104350 11/2020

OTHER PUBLICATIONS

PCT/US2022/028263 International Search Report and Written Opinion, Oct. 20, 2022.

*Primary Examiner* — Kareen K Thomas
(74) *Attorney, Agent, or Firm* — Thomas | Horstemeyer, LLP

(57) ABSTRACT

A repulpable insulated shipping liner, bag, or mailer includes a flexible sealed volume having a first layer and second layer sealed together to form a housing. An insulating layer made from repulpable cellulosic material is located within the housing and is configured to be folded so as to line the interior of a box or a container, and form an insulated container for shipping and/or storage.

20 Claims, 10 Drawing Sheets

(56) References Cited

U.S. PATENT DOCUMENTS

| | | | | |
|---|---|---|---|---|
| 2018/0299059 | A1* | 10/2018 | Mcgoff | B32B 3/28 |
| 2019/0047774 | A1* | 2/2019 | Veiseh | B65D 81/3897 |
| 2019/0100371 | A1* | 4/2019 | Cardinale | B65D 81/3858 |
| 2019/0202621 | A1* | 7/2019 | Rogers | B65D 5/36 |
| 2019/0352069 | A1* | 11/2019 | Chen | B65D 75/5833 |
| 2020/0231365 | A1 | 7/2020 | Veiseh | |

* cited by examiner

REPULPABLE INSULATING LINERS, BAGS, AND MAILERS, AND METHODS OF MAKING AND USING THE SAME

This application is being filed as a the U.S. national stage patent application of PCT International Patent Application No. PCT/US2020/028263, filed on 9 May 2022, and entitled "REPULPABLE INSULATING LINERS, BAGS, AND MAILERS, AND METHODS OF MAKING AND USING THE SAME," which claims priority to U.S. Provisional Patent Application Ser. No. 63/190,965, filed on 20 May 2021, and entitled "REPULPABLE INSULATING LINERS, BAGS, AND MAILERS, AND METHODS OF MAKING AND USING THE SAME," the contents of both of which are incorporated herein by reference in their entirety.

FIELD OF THE INVENTION

The present invention is directed to repulpable, thermal-insulated liners, bags, and mailers primarily used in the shipping or storage of goods, foodstuffs, pharmaceuticals, samples, and like items that must be maintained within predetermined temperature ranges for predetermined periods of time in order to ensure the safety and quality of such items. The present invention is further directed to methods of making and using repulpable insulating liners, bags, and mailers.

BACKGROUND

Efforts continue to further develop sustainable recyclable insulating liners, bags, and mailers that provide superior insulation properties.

SUMMARY

The present invention addresses some of the difficulties and problems in the art by the discovery of repulpable insulating liners, bags, and mailers.

Accordingly, the present invention is directed to repulpable insulating liners, bags, and mailers. In one exemplary embodiment, the repulpable insulating liner (or repulpable insulating bag or repulpable insulating mailer) of the present invention comprises: pliable first and second layers that are bonded together so as to form a bag or an envelope configuration having (i) a bottom, (ii) walls, (iii) an opening generally opposite the bottom, (iv) a first major outer liner surface, (v) a second major outer liner surface opposite the first major outer liner surface, (vi) a first major inner liner surface, (vii) a second major inner liner surface opposite the first major inner liner surface, the first major inner liner surface and the second major inner liner surface (a) being positioned between the first major outer liner surface and the second major outer liner surface, and (b) forming an article receiving pouch of the liner accessible via the opening, the article receiving pouch comprising a pouch volume, and (viii) a liner housing volume of a first size between the pliable first and second layers; and a repulpable insulating layer positioned within the housing volume and being of a size smaller than the first size and being movable relative to the pliable first and second layers, the repulpable insulating layer comprising multiple layers of crepe paper, tissue or embossed paper-like material having (a) a first insulating material end portion positioned along the opening and extending within a first space between (i) the first major outer liner surface and (ii) the first major inner liner surface, and (b) a second insulating material end portion positioned along the opening and extending within a second space between (i) the second major outer liner surface and (ii) the second major inner liner surface.

In another exemplary embodiment, the repulpable insulating liner (or repulpable insulating bag or repulpable insulating mailer) of the present invention comprises a repulpable and recyclable insulated shipping and storage liner comprising: a pliable sealed housing formed between first and second layers that are sealed together at one or more peripheral edges thereof and being of a first size, the pliable sealed housing having a liner configuration with a liner bottom portion, liner walls, and a liner opening generally opposite the liner bottom portion; an insulating layer positioned within the pliable sealed housing and being of a size smaller than or equal to the first size and being movable relative to the pliable sealed housing, the insulating layer comprising multiple layers of crepe paper material having (a) a first insulating material end portion positioned along the opening and extending within a first space between (i) a first major outer liner surface and (ii) a first major inner liner surface, and (b) a second insulating material end portion positioned along the opening and extending within a second space between (i) a second major outer liner surface and (ii) a second major inner liner surface; and at least one liner closure capable of at least partially closing the liner opening of the liner; wherein the insulated shipping and storage liner is convertible into a substantially rectangular box form having (i) planar bottom wall portions, (ii) two pair of opposing planar side walls and (iii) at least one top wall portion, each of which is foldable over upper edges of the two pair of opposing side walls whereby, when the insulated shipping and storage liner is inserted into an outer box shipping or storage container, the insulated shipping and storage liner conforms to an interior configuration of the outer box shipping or storage container, when inserted into the outer box shipping or storage container, and thereby provides an insulated covering for all inner surfaces of the outer shipping or storage container including opposite planar side walls, planar bottom wall and top panel of the outer box shipping or storage container when the at least one top panel is closed.

The present invention further relates to insulated shipping and storage containers comprising a box. In one exemplary embodiment, the insulated shipping and storage container comprises: an outer box shipping and storage container comprising at least a planar bottom wall, two sets of opposing planar side walls and at least one top panel; and any one of the herein described repulpable insulating liners, repulpable insulating bags, or repulpable insulating mailers.

The present invention further relates to methods of making repulpable insulating liners, bags, and mailers. In one exemplary embodiment, the method of making a repulpable insulating liner (or a repulpable insulating bag or a repulpable insulating mailer) comprises: a method of making one of the herein-described repulpable insulating liners (or bags or mailers) or the herein-described insulated shipping and storage containers or the herein-described insulated shipping and storage liners (or bags or mailers), the method comprising: positioning the repulpable insulating layer along at least one of the pliable first and second layers; bonding outer edges of the pliable first and second layers to form the housing volume; and bonding outer edges of the pliable first and second layers to form the bag configuration having (i) the bottom, (ii) the walls, (iii) the opening generally opposite the bottom, (iv) the first major outer liner surface, (v) the second major outer liner surface opposite the first major outer liner surface, (vi) the first major inner liner surface, and (vii) the second major inner liner surface opposite the first major inner liner surface.

The present invention even further relates to methods of using repulpable insulating liners, bags, and mailer. In one exemplary embodiment, the method of using a repulpable insulating liner (or a repulpable insulating bag or a repulpable insulating mailer) comprises a method of maintaining an item at a desired temperature, wherein the method comprises: positioning the item within an insulated shipping and storage liner (or bag or mailer), the insulated shipping and storage liner comprising one of the herein-described repulpable insulating liners (or bags or mailers) or the herein-described insulated shipping and storage containers or the herein-described insulated shipping and storage liners (or bags or mailers).

In another exemplary embodiment, the method of using a repulpable insulating liner (or a repulpable insulating bag or a repulpable insulating mailer) comprises a method of using a repulpable insulating liner (or bag or mailer), wherein the method comprises: insulating an item within one of the herein-described repulpable insulating liners (or bags or mailers) or the herein-described insulated shipping and storage containers or the herein-described insulated shipping and storage liners (or bags or mailers). Subsequent method steps may include, but are not limited to, using the multiple layers of crepe paper material of the repulpable insulating liner as a wipe (e.g., an absorbent wipe) or a towel (e.g., a hand towel).

These and other features and advantages of the present invention will become apparent after a review of the following detailed description of the disclosed embodiments and the appended claims.

BRIEF DESCRIPTION OF THE FIGURES

The present invention is further described with reference to the appended figures, wherein.

DETAILED DESCRIPTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

Figure 1:
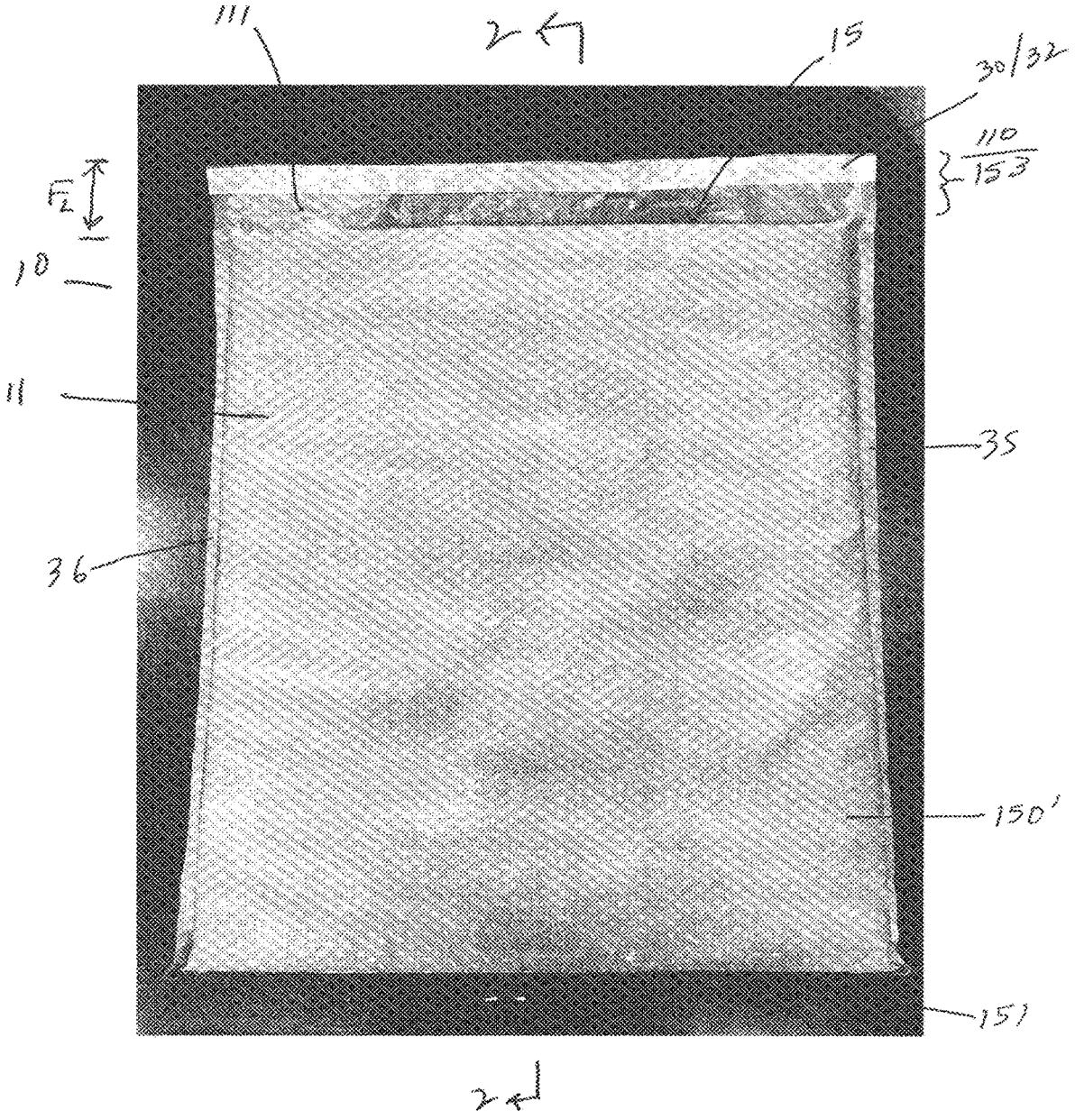
FIG. 1 is a perspective view of an exemplary repulpable insulating liner.
Figure 2:
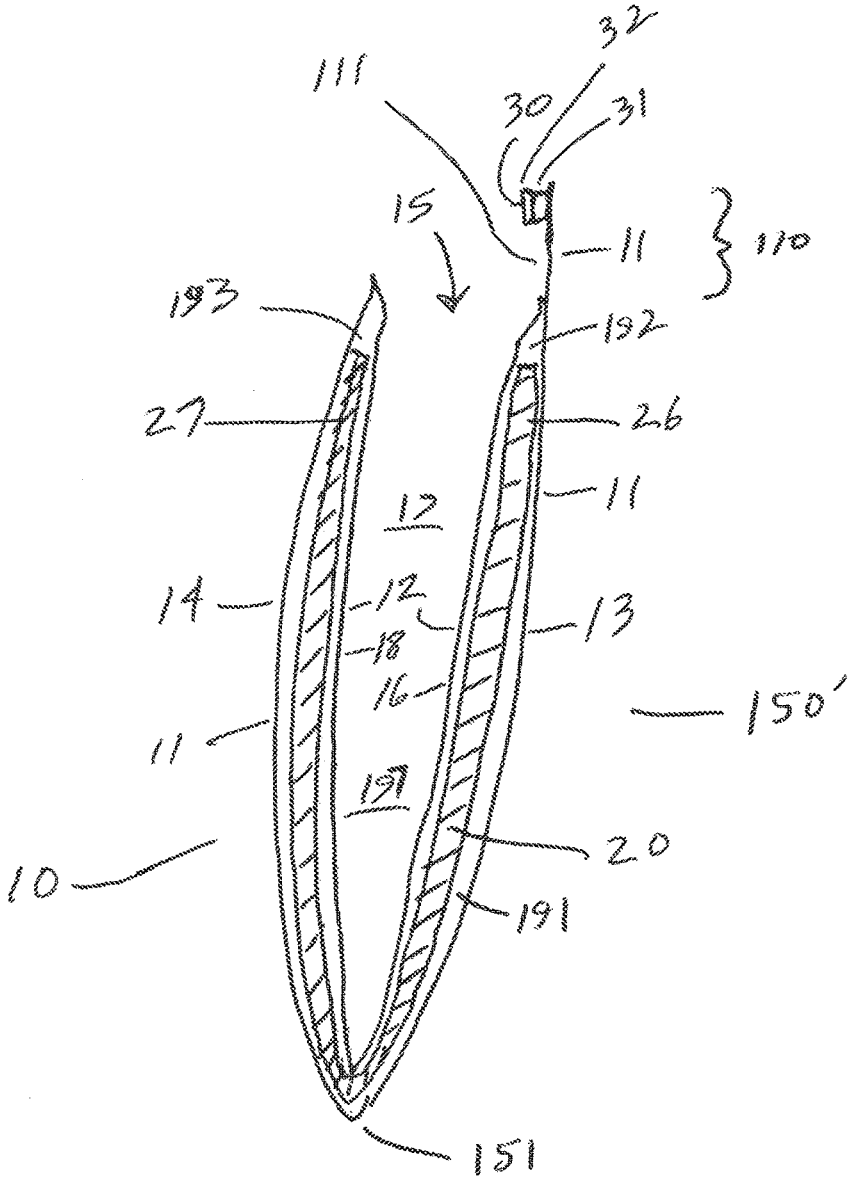
FIG. 2 is a cross-sectional view of the exemplary repulpable insulating liner shown in FIG. 1 as viewed along line 2-2 shown in FIG. 1.
Figure 3:
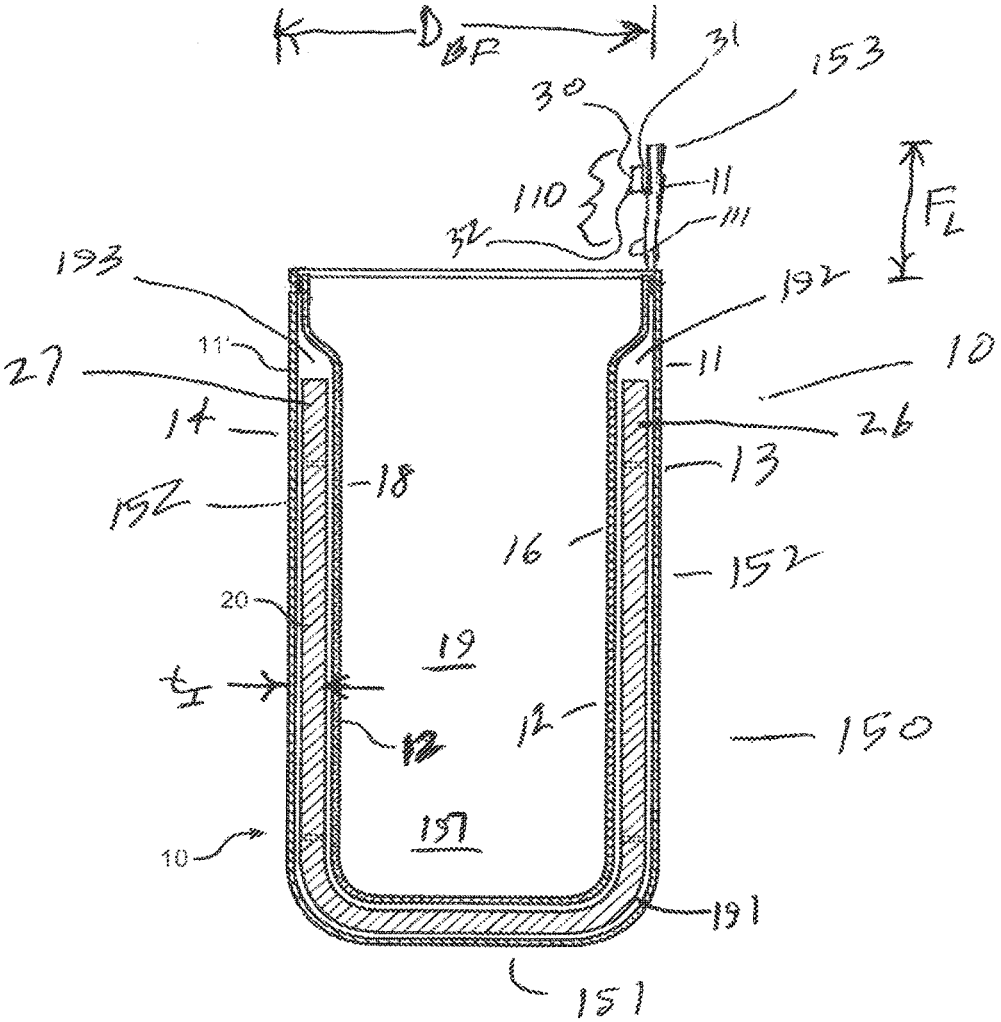
FIG. 3 is a cross-sectional view of the exemplary repulpable insulating liner shown in FIG. 1 as viewed along line 2-2 shown in FIG. 1 when the exemplary repulpable insulating liner is formed into a bag configuration.

With continued reference to the drawings, the present invention will be described with respect to several embodiments for insulated and flexible or pliable hot/cold storage and shipping repulpable insulating liners, bags, and mailers. As shown in FIG. 1, a thermally insulated, repulpable insulating liner 10 of the present invention is shown. The repulpable insulating liner 10 is a multi-layer structure for storing and shipping temperature sensitive items. The repulpable insulating liner 10 comprises at least three layers of materials: (1) an outer layer 11 (also referred to herein as pliable first layer 11), (2) an inner layer 12 (also referred to herein as pliable second layer 12, shown in FIGS. 2-3), and (3) a repulpable insulating layer 20.

Each of outer layer 11 and inner layer 12 may be independently formed as a one-piece rectangular sheet of material (e.g., a sheet of paper) that is folded along a midline thereof to create a pouch or envelope or bag shape having a bottom portion 151 (See again, FIGS. 2-3), with at least one side edge thereof being welded, heat sealed or otherwise bonded to form opposite outer edges 35/36, thereby creating an opening 15 defined by outer layer 11 and inner layer 12.

Intermediate repulpable insulating layer 20 is constructed of repulpable insulating materials known for having low thermal transfers. Such repulpable insulating materials include, but are not limited to, low density collapsible or compressible layers of cellulosic fibrous material (e.g., paper fibers). The cellulosic layers can be shaped (i.e., die-cast (e.g., molded)) or cut and shaped to form a multiple-layered structure of individual, shaped, non-planar cellulosic fiber-containing layers, which prevent any thermal bridges within the liner 10. Desirably, the repulpable insulating layer 20 comprises multiple layers 21 of shaped, non-planar paper material 22, as described below.

Thermal bridges are created when poorly insulated materials, or gaps present in the materials, allow heat transfer to occur through the material. To prevent thermal bridges, the repulpable insulating material(s) of repulpable insulating layer 20 is designed and placed to properly insulate the area of concern in which an item (not shown) to be contained within repulpable insulating liner 10 is to be received (i.e., pouch volume 197). In view of this, the repulpable insulating layer 20 is preferably made from multiple layers 21 of shaped, non-planar paper material 22, such as "crepe paper" 22, embossed tissue 22, or any other embossed paper-like material 22, to prevent thermal bridges and to effectively maintain the low thermal transfer needed to assure that any perishable product is maintained at optimal temperatures. In addition to the low thermal transfer properties and high insulating value of the shaped, non-planar paper material 22, the shaped, non-planar paper material 22 is able to conform to any item enclosed within repulpable insulating liner 10, and to thereby become the frame and/or structure of the item. The deformable shaped, non-planar paper material 22 can create a base or floor, lid, and walls for a product when the product is placed therein. The shaped, non-planar paper material 22 also provides a protective cushion for any articles placed within repulpable insulating liner 10 and thus protects against article damage.

Figure 4A:
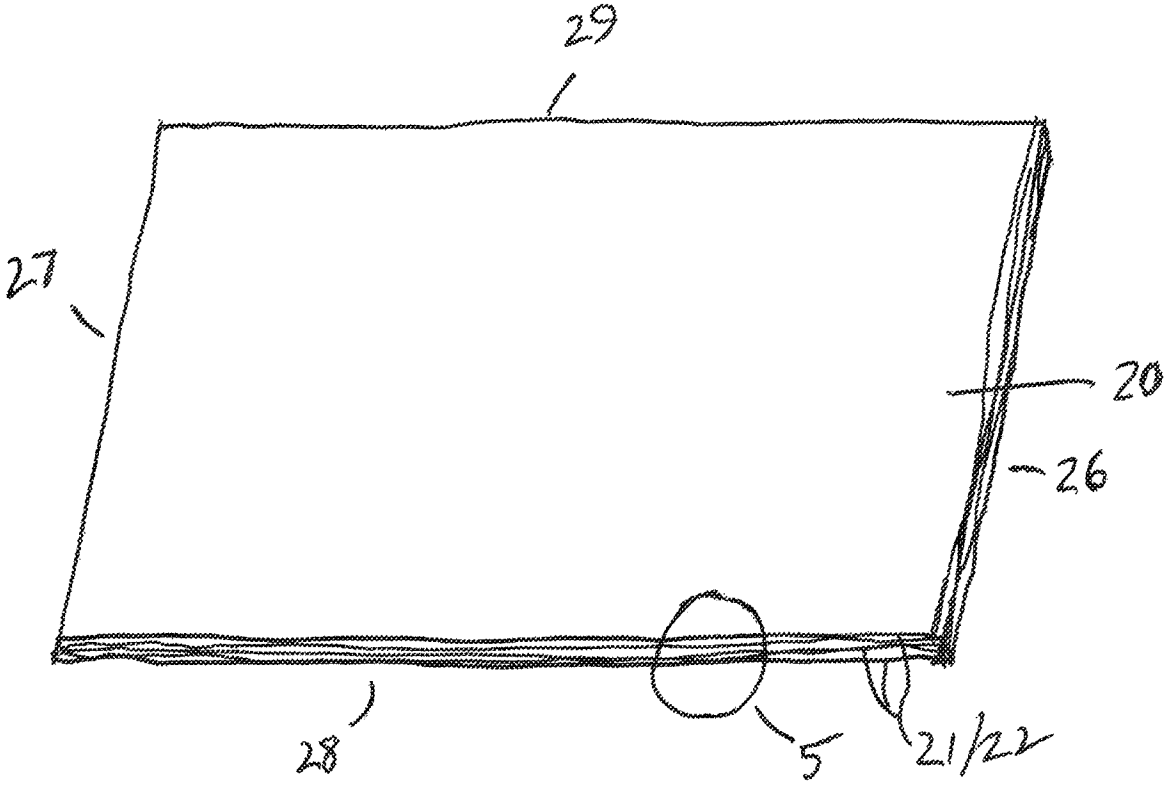
FIGS. 4A-4B depict top perspective views of possible exemplary repulpable insulating layers suitable for use in the exemplary repulpable insulating liner shown in FIG. 1.
Figure 4B:
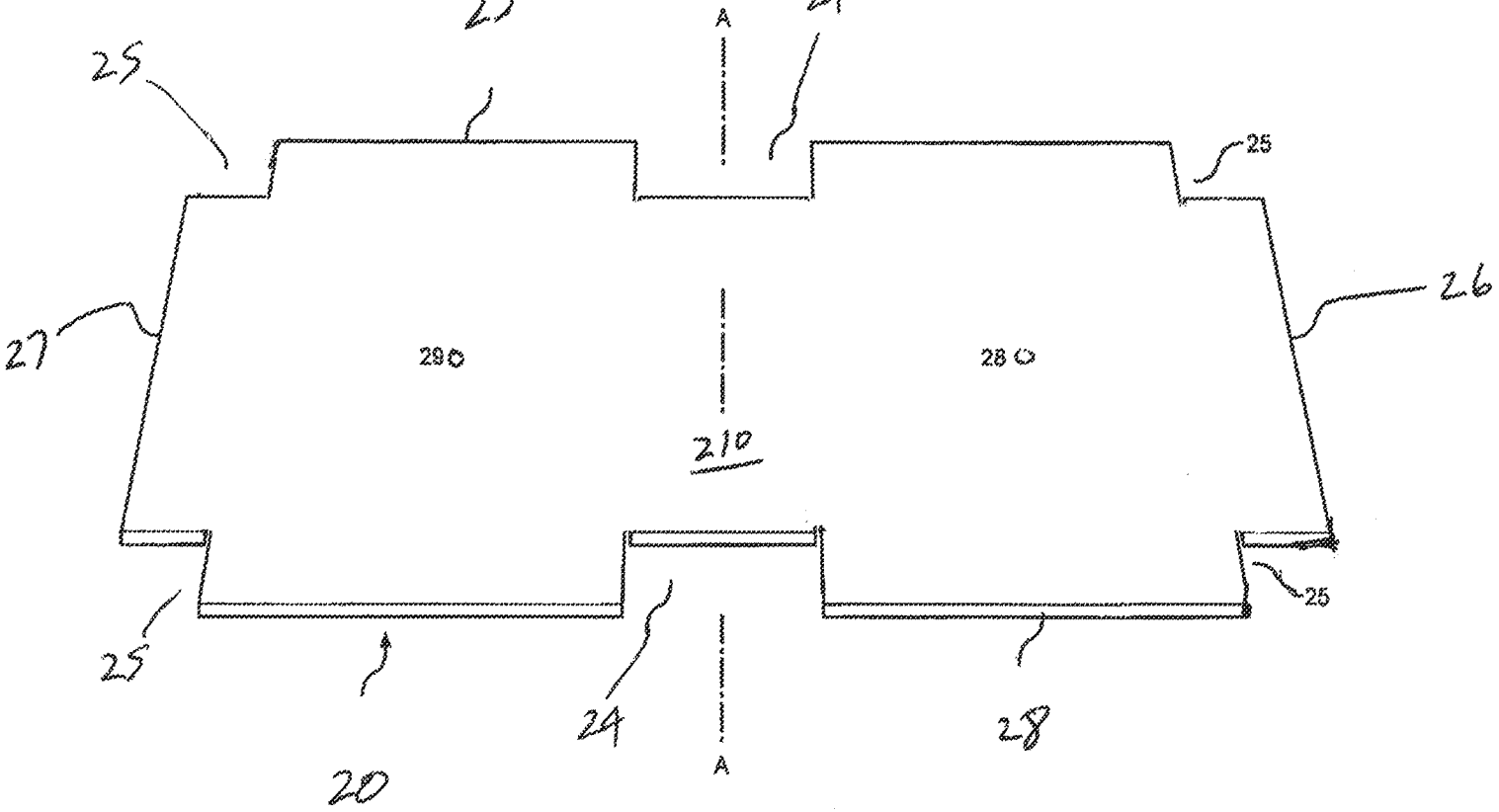
Figure 5:
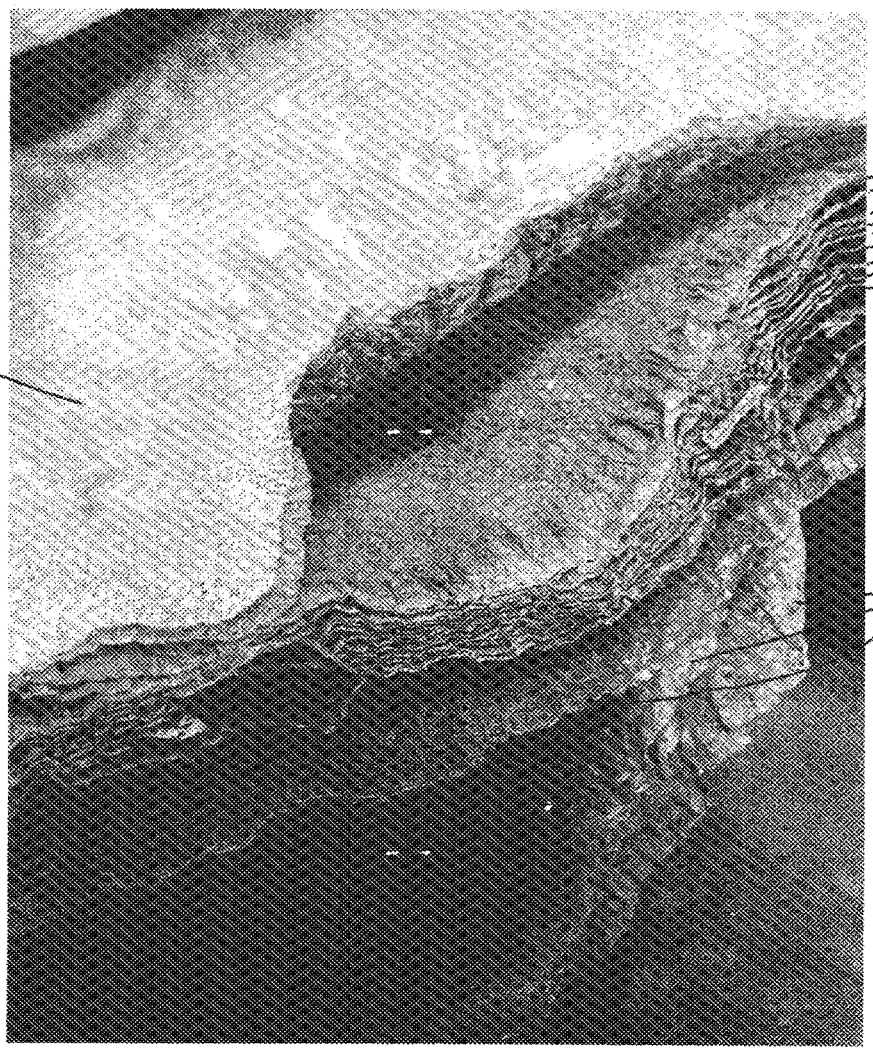
FIG. 5 depicts a close-up view of the exemplary repulpable insulating layer shown in FIG. 4A.

With reference to FIGS. 4A-4B, repulpable insulating layer 20 may be between approximately 1/16 inch (in) (0.0625 in) to about 5.0 inches (in) in thickness and may range in density. The repulpable insulating layer 20 is preferably in the form of a sheet that is generally rectangular in shape as shown in FIG. 4A. While the repulpable insulating layer 20 may comprise cut-outs 24 and 25 shown in FIG. 4B, typically such cut-outs 24 and 25 are not necessary when using repulpable insulating layer 20.

Although not shown in the drawings, in some embodiments, the inner pouch-like structure of inner layer 12 may be sealed at opening 15 after articles or items (not shown) are placed within the pouch volume 197 of repulpable insulating liner 10. In other embodiments, mechanical zip-like closures, punch out or loop handles, or double-sided tapes, or a combination of several means of closure (e.g., double-sided tape+zip-like, double-sided tape+handle) may be used to seal opening 15 after articles or items are placed therein. In yet other embodiments, the inner layer 12 may not be sealed at opening 15.

Desirably, an upper end of the outer layer 11 of repulpable insulating liner 10 is provided with a liner closure 30 that either heat seals or mechanically locks or friction locks or adhesively bonds the upper end of the outer layer 11 to an opposite upper end of the repulpable insulating liner 10, opposite opening 15, so as to close opening 15. See, exemplary liner closure 30 shown in FIG. 1 in the form of an adhesive strip (i.e., shown covered by adhesive strip release liner 32).

Although not shown in the figures, in some embodiments one or more additional repulpable insulating layers 20 may be inserted between the inner pouch or inner layer 12 and outer layer 11 to increase the insulating properties of repulpable insulating liner 10, thus increasing the length of time products will remain at optimal temperatures within repulpable insulating liner 10.

As noted above, repulpable insulating liner 10 can be utilized on its own for shipping and storing goods. Alternatively, repulpable insulating liner 10 can be utilized as a liner within an outer container, such as a cardboard box or the like. One of the advantages of the present invention is that the repulpable insulating liners 10 may be compactly arranged and retained either for storage or shipment to wholesalers or end users to thereby reduce shipping package volumes and thus reduce costs associated with shipping and storage of repulpable insulating liner 10.

In use, the repulpable insulating liner 10 may be a bendable (i.e., deformable) continuous sheet of repulpable insulating material (e.g., multiple layers of crepe paper material), without any perforations or the like marring the surface of the repulpable insulating layer 20. With this configuration, repulpable insulating layer 20 can be folded by a user along one or more fold lines to transition repulpable insulating liner 10 from a substantially flat storage position (as shown in FIG. 1) to a three-dimensional box form depicted in FIGS. 3 and 6.

Figure 6:
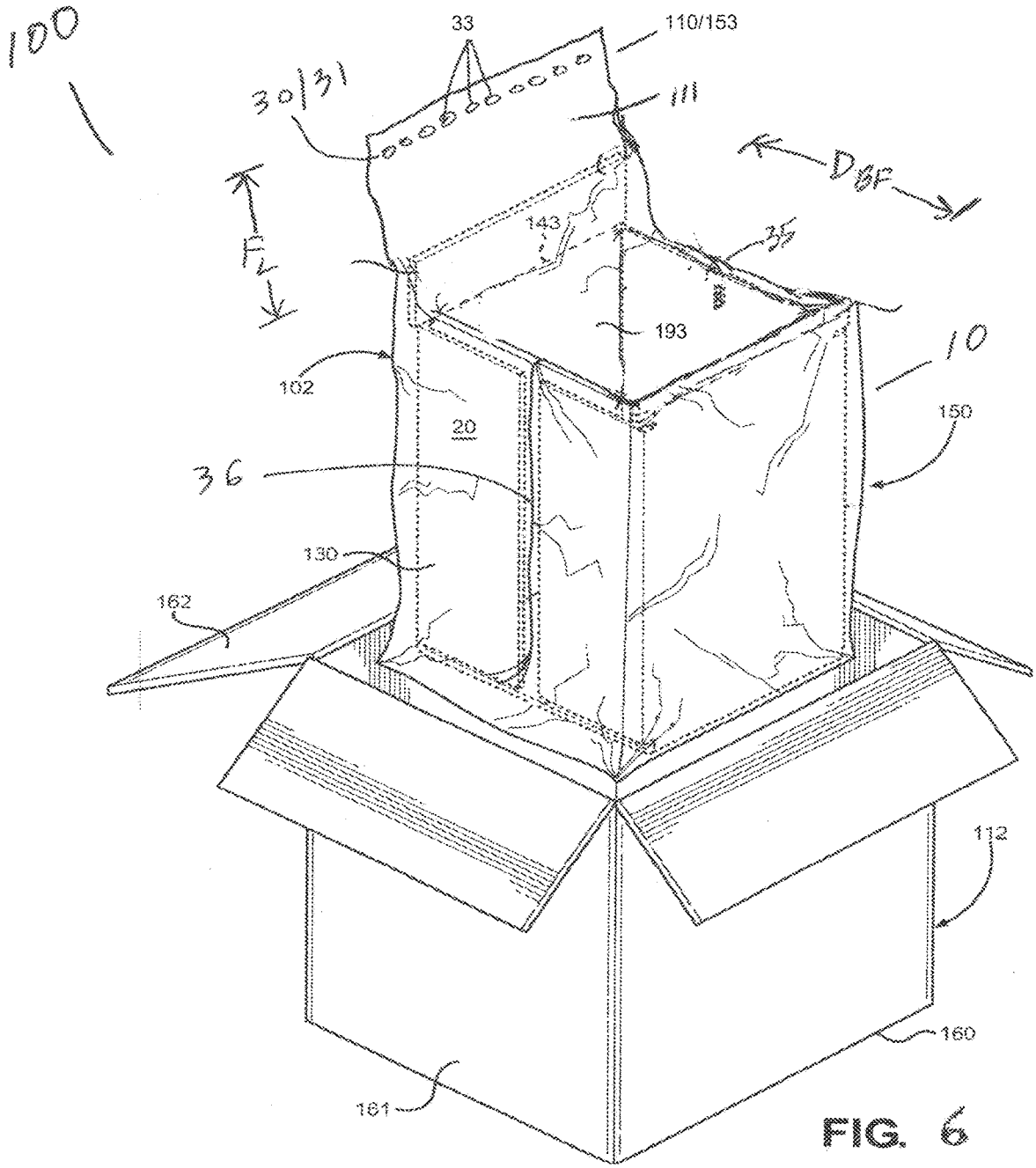
FIG. 6 depicts (i) the exemplary repulpable insulating liner shown in FIG. 1 when the exemplary repulpable insulating liner is formed into a bag configuration in combination with (ii) an outer box.
Figure 7:
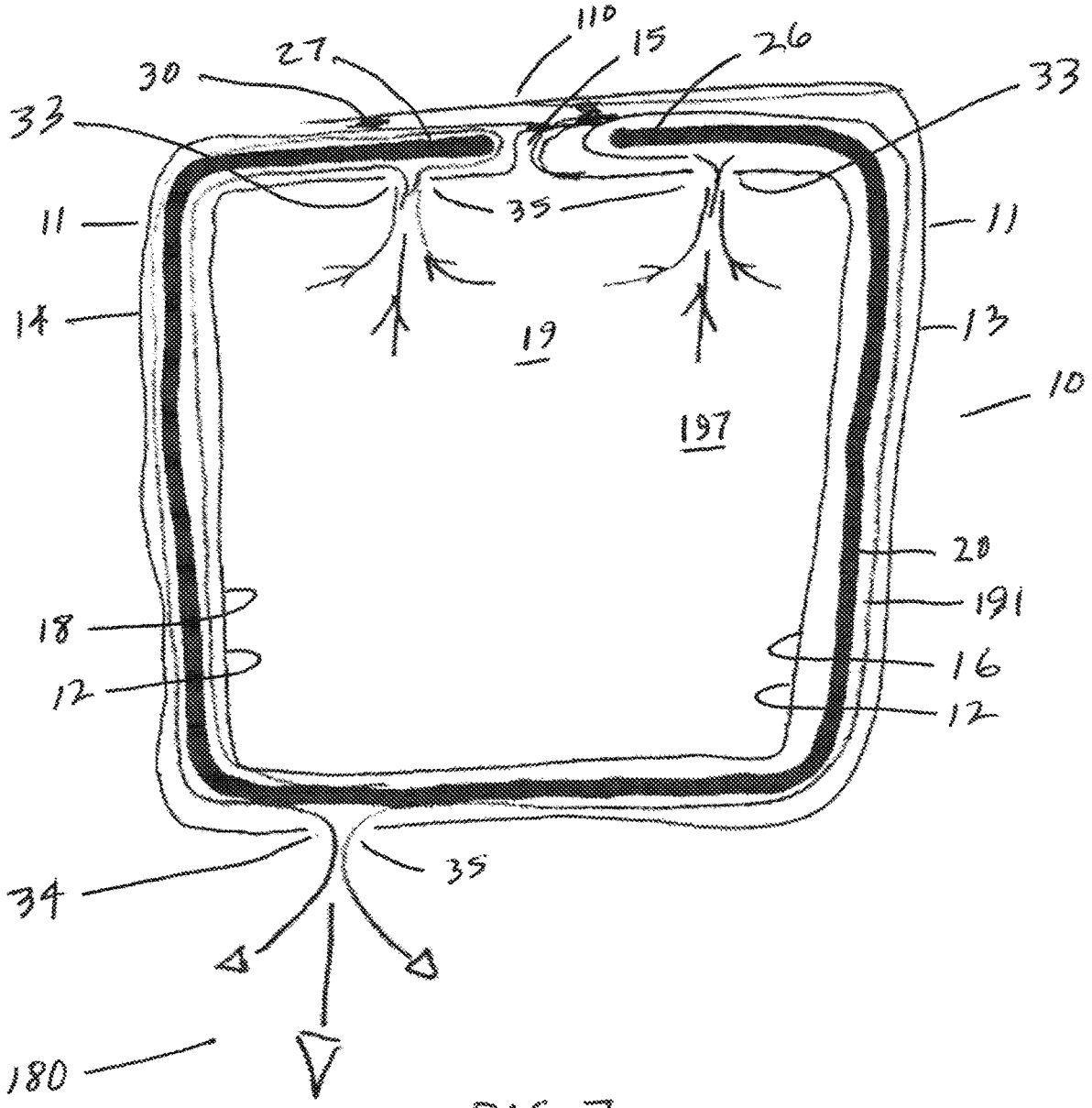
FIG. 7 is a cross-sectional view of an exemplary repulpable insulating liner shown in a sealed condition with exemplary vents allowing fluid flow from inside the sealed liner to outside the sealed liner.

Once a user positions box form/configuration 150 within a container, such as box 112, the flexible nature of repulpable insulating liner 10 enables repulpable insulating liner 10 to conform to the inner dimensions of box 112, as depicted in FIG. 6. That is, the bottom of repulpable insulating liner 10 extends along a bottom 160 of box 112, and the four sides of repulpable insulating liner 10 extend along corresponding sides 161 of box 112. A user may then insert goods (not shown) into the lined box 112 and close repulpable insulating liner 10 and box 112 for shipping or storage. More specifically, liner flap 110 can be folded along lateral fold line 143 such that liner flap 110 form a top of box form 150. When the container defined by repulpable insulating liner 10 and box 112 is in its closed position, it should be understood that the top of repulpable insulating liner 10 extends beneath a top of box 112 comprised of flaps 162.

In preferred embodiments, the resilient nature of the multiple layers of shaped, non-planar paper material 22 (e.g., crepe paper material 22) used for repulpable insulating layer 20 provides cushioning and insulation for items within box form 150. It is noted that bag/sack 102 (see, FIG. 6) (i.e., formed by pliable first and second layers 10/11) is preferably constructed of thin, flexible material such that bag/sack 102 does not interfere with the folding of repulpable insulating layer 20, and portions of bag/sack 102 which extend beyond the peripheral edges of repulpable insulating layer 20 can simply be tucked into the free space within box 112 when repulpable insulating liner 10 is in its folded position.

As discussed herein, the present invention is directed to repulpable insulating liners 10, repulpable insulating bags 102, and repulpable insulating mailers 10. The present invention is further directed to methods of making repulpable insulating liners 10, repulpable insulating bags 102, and repulpable insulating mailers 10. The present invention is even further directed to methods of using repulpable insulating liners 10, repulpable insulating bags 102, and repulpable insulating mailers 10.

The (I) repulpable insulating liners 10, repulpable insulating bags 102, and repulpable insulating mailers 10 of the present invention, (II) methods of using repulpable insulating liners 10, repulpable insulating bags 102, and repulpable insulating mailers 10, and (III) methods of using repulpable insulating liners 10, repulpable insulating bags 102, and repulpable insulating mailers 10 are further described in the following additional embodiments. It should be noted that the terms "liner," "bag," and "mailer" are all used, interchangeably, to describe the repulpable insulating liners 10 described herein and below.

ADDITIONAL EMBODIMENTS

Repulpable Insulating Liners

1. A repulpable insulating liner 10 comprising: pliable first and second layers 11/12 that are bonded together so as to form a bag configuration 150 or an envelope configuration 150' having (i) a bottom 151, (ii) walls 152, (iii) an opening 15 generally opposite the bottom 151, (iv) a first major outer liner surface 13, (v) a second major outer liner surface 14 opposite said first major outer liner surface 13, (vi) a first major inner liner surface 16, (vii) a second major inner liner surface 18 opposite said first major inner liner surface 16, said first major inner liner surface 16 and said second major inner liner surface 18 (*a*) being positioned between said first major outer liner surface 13 and said second major outer liner surface 14, and (b) forming an article receiving pouch 19 of said liner 10 accessible via said opening 15, said article receiving pouch 19 having a pouch volume 197, and (viii) a liner housing volume 191 of a first size between said pliable first and second layers 11/12; and a repulpable insulating layer 20 positioned within the liner housing volume 191 and being of a size smaller than the first size and being movable relative to the pliable first and second layers 11/12, the repulpable insulating layer 20 comprising multiple layers 21 of shaped, non-planar paper material 22 having (a) a first insulating material end portion 26 positioned along said opening 15 and extending within a first space 192 between (i) said first major outer liner surface 13 and (ii) said first major inner liner surface 16, and (b) a second insulating material end portion 27 positioned along said opening 15 and extending within a second space 193 between (i) said second major outer liner surface 14 and (ii) said second major inner liner surface 18.

2. The repulpable insulating liner 10 of embodiment 1, wherein the liner 10 is configured to be convertible into a substantially rectangular box form 250 having a bottom wall 151, two pair of opposing side walls 152 and a liner top wall 153, said liner top wall 153 being foldable over the two pair of opposing side walls 152 whereby, when the liner 10 is inserted into an open box outer shipping or storage container 112, the liner 10 conforms to an interior configuration of the outer box shipping and storage container 112 and thereby provides an insulated covering for all inner surfaces of the outer shipping or storage container 112, when inserted into the outer box shipping or storage container 112, including the bottom wall 160, opposite side walls 161, and top wall 162 of the outer box shipping or storage container 112 when the liner top wall 153 is closed. See, for example, FIG. 6.

3. The repulpable insulating liner 10 of embodiment 1 or 2, wherein the repulpable insulating layer 20 is positioned within the liner housing volume 191 but otherwise unattached to the pliable first and second layers 11/12.

4. The repulpable insulating liner 10 of any one of embodiments 1 to 3, wherein the repulpable insulating layer 20 has a rectangular shape with said first insulating material end portion 26 and said second insulating material end portion 27 being along opposite edges of the rectangular shape. See, for example, FIG. 4A.

5. The repulpable insulating liner 10 of any one of embodiments 1 to 4, wherein said repulpable insulating layer 20 further comprises opposing cut outs 24 generally centrally along opposite side edges 28/29 of said repulpable insulating layer 20 so as to form a middle portion 210 between two side portions 280/290, said opposing cut outs 25 enabling a free standing configuration whereby said repulpable insulating layer 20 is folded centrally thereof so that said middle portion 210 becomes the bottom 151, and said side portions 280/290 become the walls 152. See, FIG. 4B.

6. The repulpable insulating liner 10 of any one of embodiments 1 to 5, wherein said repulpable insulating layer 20 has a rectangular shape with cut outs 25 at each of four corners of said rectangular shape. See again, FIG. 4B.

7. The repulpable insulating liner 10 of any one of embodiments 1 to 6, wherein said repulpable insulating layer 20 comprises from about 4 to about 50 layers 21 of shaped, non-planar paper material 22.

8. The repulpable insulating liner 10 of any one of embodiments 1 to 7, wherein said repulpable insulating layer 20 comprises from about 12 to about 20 layers 21 of shaped, non-planar paper material 22.

9. The repulpable insulating liner 10 of any one of embodiments 1 to 8, wherein each layer 21 of shaped, non-planar paper material 22 (i) comprises shaped, non-planar paper 22, (ii) has an average paper layer thickness of from about 0.1 millimeters (mm) to about 5.0 mm, and (iii) has a paper layer density between about 15 g/m$^3$ and about 65 g/m$^3$.

10. The repulpable insulating liner 10 of any one of embodiments 1 to 9, wherein each layer 21 of shaped, non-planar paper material 22 comprises at least 80% by weight of reclaimable paper pulp. In some embodiments, each layer 21 of shaped, non-planar paper material 22 comprises from about 80% by weight to about 100% by weight of reclaimable paper pulp (or any value between 80 and 100, in increments of 0.1, e.g., from about 81.4 wt %. or any range of values between 80.0 and 100.0, in increments of 0.1, e.g., from about 80.0 wt % to about 95.0 wt %).

11. The repulpable insulating liner 10 of any one of embodiments 1 to 10, wherein each layer 21 of shaped, non-planar paper material 22 comprises crepe paper, embossed paper, embossed tissue paper, or any combination thereof. Embossing provides each layer with loft and creates air channels/layers, which contribute to the overall thermal properties of said repulpable insulating layer 20.

12. The repulpable insulating liner 10 of any one of embodiments 1 to 11, wherein each layer 21 of shaped, non-planar paper material 22 comprises crepe paper.

13. The repulpable insulating liner 10 of any one of embodiments 1 to 12, wherein said repulpable insulating layer 20 has an overall thickness $t_1$ of from about 0.25 inches (in) (6.35 mm) to about 3.0 in (76.20 mm).

14. The repulpable insulating liner 10 of any one of embodiments 1 to 13, wherein said repulpable insulating layer 20 has an overall thickness $t_1$ of from about 0.5 in (12.70 mm) to about 1.5 in (38.10 mm).

15. The repulpable insulating liner 10 of any one of embodiments 1 to 14, wherein said repulpable insulating layer 20 has (i) an overall thickness $t_1$ of about 0.5 in (12.70 mm), and (ii) an R-value equal to or greater than an R-value of a 1 lb per cubic foot density polyurethane foam insulating layer having a foam layer thickness of about 1.0 in (25.40 mm).

16. The repulpable insulating liner 10 of any one of embodiments 1 to 15, wherein the pliable first and second layers 11/12 each independently comprises a cellulosic fiber-containing layer, a polymeric layer, or a combination thereof.

17. The repulpable insulating liner 10 of any one of embodiments 1 to 16, wherein the pliable first and second layers 11/12 each independently comprises a paper layer.

18. The repulpable insulating liner 10 of any one of embodiments 1 to 17, wherein the pliable first and second layers 11/12 each independently comprises a paper layer comprising at least 80% by weight of reclaimable paper pulp. In some embodiments, each of the pliable first and second layers 11/12 comprises from about 80% by weight to about 100% by weight of reclaimable paper pulp (or any value between 80 and 100, in increments of 0.1, e.g., from about 81.4 wt %. or any range of values between 80.0 and 100.0, in increments of 0.1, e.g., from about 80.0 wt % to about 95.0 wt %).

19. The repulpable insulating liner 10 of any one of embodiments 1 to 18, wherein said first major outer liner surface 13 extends beyond said opening 15 to form a liner flap 110.
20. The repulpable insulating liner 10 of embodiment 19, wherein said liner flap 110 has a rectangular configuration.
21. The repulpable insulating liner 10 of embodiment 19 or 20, wherein said liner flap 110 extends a length $F_L$ beyond said opening 15, and length $F_L$ is equal to or greater than a box form depth $D_{BF}$ of the repulpable insulating liner 10 when configured into a substantially rectangular box configuration 150. See, FIGS. 3 and 6.
22. The repulpable insulating liner 10 of any one of embodiments 19 to 21, wherein said liner top wall 153 comprises said liner flap 110.
23. The repulpable insulating liner 10 of any one of embodiments 19 to 22, wherein said first insulating material end portion 26 extends into said liner flap 110.
24. The repulpable insulating liner 10 of any one of embodiments 1 to 23, wherein said pliable first and second layers 11/12 are portions of a continuous recyclable and repulpable liner substrate (not shown) that is folded over onto itself to form (i) said first major outer liner surface 13, (ii) said second major outer liner surface 14 opposite said first major outer liner surface 13, (iii) said first major inner liner surface 16, and (iv) said second major inner liner surface 18 opposite said first major inner liner surface 16. See, for example, FIG. 2.
25. The repulpable insulating liner 10 of embodiment 24, wherein said continuous recyclable and repulpable liner substrate comprises a paper substrate.
26. The repulpable insulating liner 10 of any one of embodiments 1 to 25, wherein outer edges 35/36 of said pliable first and second layers 11/12 are bonded to one another via an edge adhesive (not shown).
27. The repulpable insulating liner 10 of embodiment 26, wherein said edge adhesive comprises a water-based glue. It should be understood that any form of adhesion may be used to bond outer edges 35/36 of said pliable first and second layers 11/12 to one another. For example, instead of an adhesive or glue, a thermoplastic film or strip may be melted so as to heat-seal outer edges 35/36 of said pliable first and second layers 11/12 to one another.
28. The repulpable insulating liner 10 of any one of embodiments 1 to 27, further comprising: a liner closure 30 capable of at least partially closing said opening 15 of said liner 10. See, FIGS. 1-3 and 6.
29. The repulpable insulating liner 10 of embodiment 28, wherein said liner closure 30 comprises a strip of adhesive 31 and a peel-off adhesive release liner 32 over the strip of adhesive 31. See, FIGS. 1-3.
30. The repulpable insulating liner 10 of embodiment 29, wherein said strip of adhesive 31 comprises a pattern of adhesive portions 33. See, FIG. 6.
31. The repulpable insulating liner 10 of embodiment 29 or 30, wherein said strip of adhesive 31 comprises adhesive portions 33 separated from one another. Like the edge adhesive, discussed above, the strip of adhesive 31 and/or adhesive portions 33 may comprise a water-based glue, or alternatively, may comprise any other form of adhesion so as to at least partially close said opening 15 of said liner 10.
32. The repulpable insulating liner 10 of any one of embodiments 28 to 31, wherein said liner closure 30 is positioned along said liner flap 110.
33. The repulpable insulating liner 10 of any one of embodiments 28 to 32, wherein said liner closure 30 is positioned along an inner surface 111 of said liner flap 110.
34 The repulpable insulating liner 10 of any one of embodiments 1 to 33, wherein said repulpable insulating liner 10 consists of said pliable first and second layers 11/12, said repulpable insulating layer 20, and said liner closure 30.
35. An insulated shipping and storage container 100 comprising: an outer box shipping and storage container 112 comprising at least a planar bottom wall 160, two sets of opposing planar side walls 161 and at least one top panel 162; and the repulpable insulating liner 10 of any one of embodiments 1 to 34.
36. The insulated shipping and storage container 100 of embodiment 35, wherein the repulpable insulating liner 10 is positioned within the outer box shipping and storage container 112.
37. The insulated shipping and storage container 100 of embodiment 35 or 36, wherein the repulpable insulating liner 10 is attached to the outer box shipping and storage container 112.
38. The insulated shipping and storage container 100 of any one of embodiments 35 to 37, wherein the insulated shipping and storage container 100 is repulpable.
39. A repulpable and recyclable insulated shipping and storage liner 10 comprising: a pliable sealed housing volume 191 formed between first and second layers 11/12 that are bonded together at one or more peripheral edges 35/36 thereof and being of a first size, said pliable sealed housing volume 191 having a liner configuration with a liner bottom portion 150, liner walls 152, and a liner opening 15 generally opposite the liner bottom portion 150, said opening providing access to an article receiving pouch 19 having a pouch volume 197; an insulating layer 20 positioned within the pliable sealed housing 191 and being of a size smaller than or equal to the first size and being movable relative to the pliable sealed housing 191, the insulating layer 20 comprising multiple layers 21 of crepe paper material 22 having (a) a first insulating material end portion 26 positioned along said opening 15 and extending within a first space 192 between (i) a first major outer liner surface 13 and (ii) a first major inner liner surface 16, and (b) a second insulating material end portion 27 positioned along said opening 15 and extending within a second space 193 between (i) a second major outer liner surface 14 and (ii) a second major inner liner surface 18; and at least one liner closure 30 capable of at least partially closing said liner opening 15 of said liner 10; wherein the insulated shipping and storage liner 10 is convertible into a substantially rectangular box form 150 having (i) planar bottom wall portions 151, (ii) two pair of opposing planar side walls 152 and (iii) at least one top wall portion 153, each of which is foldable over upper edges of the two pair of opposing side walls 152 whereby, when the insulated shipping and storage liner 10 is inserted into an outer box shipping or storage container 112, the insulated shipping and storage liner 10 conforms to an interior configuration of the outer box shipping or storage container 112, when inserted into the outer box shipping or storage container 112, and thereby provides an insulated covering for all inner surfaces of the outer shipping or storage container 112 including opposite planar side walls 161, planar bottom wall 160 and top panel 163 of the outer box shipping or storage container 112 when the at least one top panel 163 is closed. See again, FIG. 6.

40. The insulated shipping and storage liner 10 of embodiment 39, wherein said insulated shipping and storage liner 10 consists of said pliable sealed housing 191 consisting of said first and second layers 11/12, said repulpable insulating layer 20, and said at least one liner closure 30.

41. The repulpable insulating liner 10 of any one of embodiments 1 to 34, or the insulated shipping and storage container 100 of any one of embodiments 35 to 38, or the repulpable and recyclable insulated shipping and storage liner 10 of embodiment 39 or 40, wherein (I) at least one of (i) said first major inner liner surface 16, and (ii) said second major inner liner surface 18 further comprises one or more inlet vents 33 extending therethrough and providing fluid communication between (a) an enclosed or enclosable pouch volume 197 bound by (i) said first major inner liner surface 16, and (ii) said second major inner liner surface 18, and (b) said liner housing volume 191, and (II) at least one of (i) said first major outer liner surface 13, and (ii) said second major outer liner surface 14 further comprises one or more outlet vents 34 extending therethrough and providing fluid communication between (a) said liner housing volume 191, and (b) a point 180 outside of said insulated shipping and storage container 100.

42. The repulpable insulating liner 10 or the insulated shipping and storage container 100 or the repulpable and recyclable insulated shipping and storage liner 10 of embodiment 41, wherein each of said one or more inlet vents 33 and said one or more outlet vents 34 independently comprises a one-way valve (not shown) that allows fluid flow in one direction but resists fluid flow in an opposite direction. It should be understood that each of the one or more inlet vents 33 and the one or more outlet vents 34 may independently comprise any desired type of opening 35 with any desired configuration. For example, each of the one or more inlet vents 33 and the one or more outlet vents 34 may independently comprise a small slit or hole, multiple small slits or holes, a one-way valve, a resealable opening (e.g., an opening with a cap for closing the opening), or any other type of opening 35.

43. The repulpable insulating liner 10 or the insulated shipping and storage container 100 or the repulpable and recyclable insulated shipping and storage liner 10 of embodiment 41 or 42, wherein (I) each of said one or more inlet vents 33 is positioned (i) proximate said opening 15 and (ii) along first insulating material end portion 26 and/or second insulating material end portion 27, and (II) each of said one or more outlet vents 34 is positioned (i) proximate said bottom 151.

44. The repulpable insulating liner 10 or the insulated shipping and storage container 100 or the repulpable and recyclable insulated shipping and storage liner 10 of any one of embodiments 41 to 43, wherein (I) said one or more inlet vents 33 comprise (i) a first inlet vent 33 through said first major inner liner surface 16, proximate said opening 15 and along said first insulating material end portion 26, and (ii) a second inlet vent 33 through said second major inner liner surface 18, proximate said opening 15 and along said second insulating material end portion 27, and (II) each of said one or more outlet vents 34 is positioned (i) proximate said bottom 151.

45. The repulpable insulating liner 10 or the insulated shipping and storage container 100 or the repulpable and recyclable insulated shipping and storage liner 10 of any one of embodiments 1 to 44, further comprising one or more items (not shown) positioned with said pouch volume 197.

46. The repulpable insulating liner 10 or the insulated shipping and storage container 100 or the repulpable and recyclable insulated shipping and storage liner 10 of embodiment 45, wherein the one or more items comprise dry ice, a frozen item, a food item, medicine, blood, a body organ, or any combination thereof.

Methods of Using Repulpable Insulating Liners

47. A method of maintaining an item (not shown) at a desired temperature, said method comprising: positioning the item within an insulated shipping and storage liner, the insulated shipping and storage liner comprises the repulpable insulating liner 10 of any one of embodiments 1 to 34 and 41 to 46, or the insulated shipping and storage container 110 of any one of embodiments 35 to 38 and 41 to 46, or the insulated shipping and storage liner 10 of any one of embodiments 39 to 46.

48. A method of using a repulpable insulating liner 10, said method comprising: insulating an item within the repulpable insulating liner 10 of any one of embodiments 1 to 34 and 41 to 46, or the insulated shipping and storage container 110 of any one of embodiments 35 to 38 and 41 to 46, or the insulated shipping and storage liner 10 of any one of embodiments 39 to 46.

49. The method of embodiment 48, further comprising: after said insulating step, using the multiple layers 21 of crepe paper material 22 of the repulpable insulating liner 10 as a wipe or towel.

50. The method of any one of embodiments 47 to 49, wherein the item comprises a food item, medicine, blood, a body organ, or any combination thereof.

Methods of Making Repulpable Insulating Liners

51. A method of making the repulpable insulating liner 10 of any one of embodiments 1 to 34 and 41 to 46, or the insulated shipping and storage container 110 of any one of embodiments 35 to 38 and 41 to 46, or the insulated shipping and storage liner 10 of any one of embodiments 39 to 46, said method comprising: positioning the repulpable insulating layer along at least one of the pliable first and second layers 11/12; bonding outer edges 35/36 of the pliable first and second layers 11/12 to form the liner housing volume 191; and bonding outer edges 35/36 of the pliable first and second layers 11/12 to form the bag configuration 150 having (i) the bottom 151, (ii) the walls 152, (iii) the opening 15 generally opposite the bottom 151, (iv) the first major outer liner surface 13, (v) the second major outer liner surface 14 opposite the first major outer liner surface 13, (vi) the first major inner liner surface 16, and (vii) the second major inner liner surface 18 opposite the first major inner liner surface 16.

52. The method of embodiment 51, where said bonding steps take place simultaneously.

53. The method of embodiment 51 or 52, where said positioning step further comprises positioning the repulpable insulating layer 20 between the pliable first and second layers 11/12.

54. The method of any one of embodiments 51 to 53, where said positioning step comprises: unrolling a continuous recyclable and repulpable liner substrate (i.e., layers 11/12) from a roll (not shown); and folding the continuous recyclable and repulpable liner substrate over onto itself to form (a) the pliable first and second layers 11/12, and (b)(i) the first major outer liner surface 13, (ii) the second major outer liner surface 14 opposite the first major outer liner surface 13, (iii) the first major inner liner surface 16, and (iv) the second major inner liner surface 18 opposite the first major inner liner surface 16.

Figure 8:
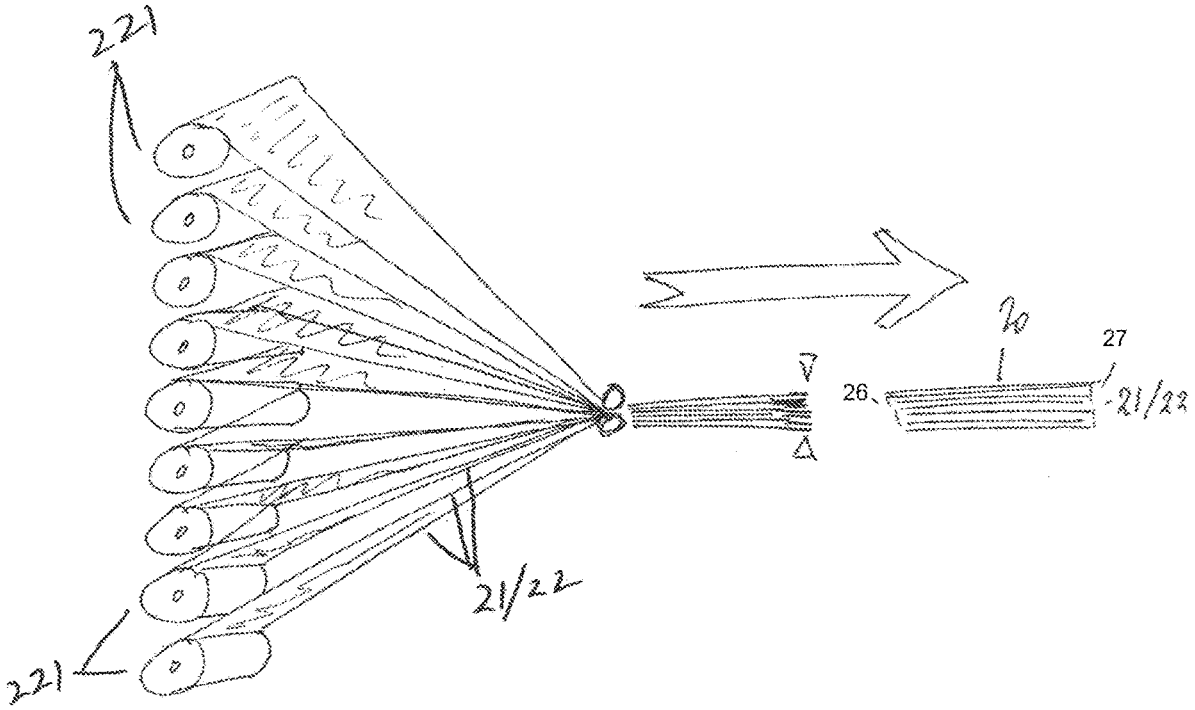
FIG. 8 is a view of an exemplary method for forming an exemplary intermediate repulpable insulating layer suitable for use in the repulpable insulating liners of the present invention.
Figure 9:
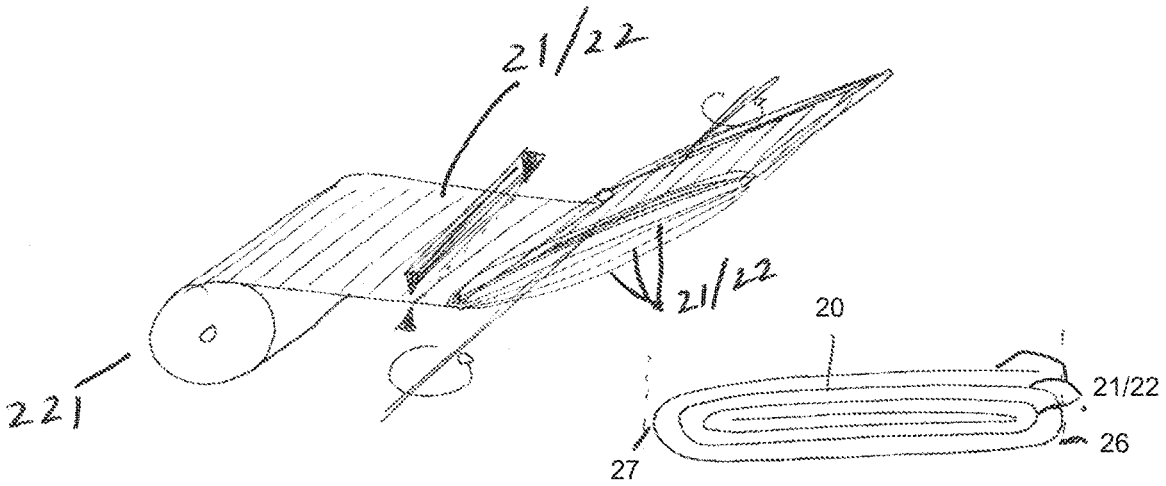
FIG. 9 is a view of another exemplary method for forming an exemplary intermediate repulpable insulating layer suitable for use in the repulpable insulating liners of the present invention.

55. The method of embodiment 54, wherein the continuous recyclable and repulpable liner substrate comprises a paper substrate.
56. The method of any one of embodiments 51 to 55, further comprising: forming a liner flap 110 that extends beyond the opening 15.
57. The method of any one of embodiments 51 to 56, further comprising: attaching a liner closure 30 onto the repulpable insulating liner 10 or the insulated shipping and storage liner 10.
58. The method of any one of embodiments 51 to 57, further comprising: attaching a liner closure 30 onto a liner flap 110 of the repulpable insulating liner 10 or the insulated shipping and storage liner 10.
59. The method of any one of embodiments 51 to 58, further comprising: forming the repulpable insulating layer 20, wherein said forming step comprises unrolling shaped, non-planar paper material 22 from multiple rolls 221 of shaped, non-planar paper material 22 to assemble multiple layers 21 of shaped, non-planar paper material 22 with one another; and cutting the multiple layers 21 of shaped, non-planar paper material 22 to a desired length. See, for example, the method of formation shown in FIG. 8. One can utilize as many rolls 221 of shaped, non-planar paper material 22 as desired so as to have an intended total number of layers 21 of shaped, non-planar paper material 22. For example, 20 rolls 221 of single layers 21 can be used to create a 20-layer repulpable insulating layer 20.
60. The method of any one of embodiments 51 to 58, further comprising: forming the repulpable insulating layer 20, wherein said forming step comprises unrolling a single layer 21 of shaped, non-planar paper material 22 from a single roll 221; folding the single layer 21 of shaped, non-planar paper material 22 onto itself as many times as needed to achieve a desired thickness and assemble multiple layers 21 of shaped, non-planar paper material 22 with one another; and cutting the multiple layers 21 of shaped, non-planar paper material 22 to a desired length. See, for example, the method of formation shown in FIG. 9.

It should be understood that although the above-described repulpable insulating liners 10, and methods are described as "comprising" one or more features, components or steps, the above-described repulpable insulating liners 10, and methods may "comprise," "consists of," or "consist essentially of" any of the above-described features, components or steps of the repulpable insulating liners 10, and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a repulpable insulating liner 10 and/or method that "comprises" a list of elements (e.g., components or steps) is not necessarily limited to only those elements (or components or steps), but may include other elements (or components or steps) not expressly listed or inherent to the repulpable insulating liner 10 and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a repulpable insulating liner 10 and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described repulpable insulating liners 10, and/or methods may comprise, consist essentially of, or consist of any of the herein-described components, features, and steps, as shown in the figures with or without any feature(s) not shown in the figures. In other words, in some embodiments, the repulpable insulating liners 10 and/or methods of the present invention do not have any additional features other than those shown in the figures, and such additional features, not shown in the figures, are specifically excluded from the repulpable insulating liners 10 and/or methods. In other embodiments, the repulpable insulating liners 10 and/or methods of the present invention do have one or more additional features that are not shown in the figures.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

Example 1

Repulpable insulating liners 10, the insulated shipping and storage containers 100, and the repulpable and recyclable insulated shipping and storage liner 10 as described in embodiments 1 to 46 were prepared. The repulpable insulating liners 10 were used to line cardboard boxes 112 and provide thermal insulation of various products (e.g., medicines, foods, etc.) positioned within the repulpable insulating liners 10 and boxes 112.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A repulpable insulating liner 10 comprising:

pliable first and second layers 11/12 that are bonded together so as to form a bag configuration 150 or an envelope configuration 150' having (i) a bottom 151, (ii) walls 152, (iii) an opening 15 opposite the bottom 151, (iv) a first major outer liner surface 13, (v) a second major outer liner surface 14 opposite said first major outer liner surface 13, (vi) a first major inner liner surface 16, (vii) a second major inner liner surface 18 opposite said first major inner liner surface 16, said first major inner liner surface 16 and said second major inner liner surface 18 (a) being positioned between said first major outer liner surface 13 and said second major outer liner surface 14, and (b) forming an article receiving pouch 19 of said liner 10 accessible via said opening 15, said article receiving pouch 19 having a pouch volume 197, and (viii) a liner housing volume 191 of a first size between said pliable first and second layers 11/12; and a repulpable insulating layer 20 positioned within the liner housing volume 191 and being of a size smaller than the first size and being movable relative to the pliable first and second layers 11/12, the repulpable insulating layer 20 comprising one or more layers 21 of shaped, non-planar paper material 22 having (a) a first insulating material end portion 26 positioned along said opening 15 and extending within a first space 192 between (i) said first major outer liner surface 13 and (ii) said first major inner liner surface 16, and (b) a second insulating material end portion 27 positioned along said opening 15 and extending within a second space 193 between (i) said second major outer liner surface 14 and (ii) said second major inner liner surface 18.

2. The repulpable insulating liner 10 of claim 1, wherein the liner 10 is configured to be convertible into a substantially rectangular box form 250 having a bottom wall 151, two pair of opposing side walls 152 and a liner top wall 153, said liner top wall 153 being foldable over the two pair of opposing side walls 152 whereby, when the liner 10 is inserted into an open box outer shipping or storage container 112, the liner 10 conforms to an interior configuration of the outer box shipping and storage container 112 and thereby provides an insulated covering for all inner surfaces of the outer shipping or storage container 112, when inserted into the outer box shipping or storage container 112, including the bottom wall 160, opposite side walls 161, and top wall 162 of the outer box shipping or storage container 112 when the liner top wall 153 is closed.

3. The repulpable insulating liner 10 of claim 1, wherein the repulpable insulating layer 20 is positioned within the liner housing volume 191 but otherwise unattached to the pliable first and second layers 11/12.

4. The repulpable insulating liner 10 of claim 1, wherein the repulpable insulating layer 20 has a rectangular shape with said first insulating material end portion 26 and said second insulating material end portion 27 being along opposite edges of the rectangular shape.

5. The repulpable insulating liner 10 of claim 1, wherein said repulpable insulating layer 20 further comprises opposing cut outs 24 centrally along opposite side edges 28/29 of said repulpable insulating layer 20 so as to form a middle portion 210 between two side portions 280/290, said opposing cut outs 25 enabling a free standing configuration whereby said repulpable insulating layer 20 is folded centrally thereof so that said middle portion 210 becomes the bottom 151, and said side portions 280/290 become the walls 152.

6. The repulpable insulating liner 10 of claim 1, wherein said repulpable insulating layer 20 has a rectangular shape with cut outs 25 at each of four corners of said rectangular shape.

7. The repulpable insulating liner 10 of claim 1, wherein said repulpable insulating layer 20 comprises from 4 to 50 layers 21 of shaped, non-planar paper material 22.

8. The repulpable insulating liner 10 of claim 1, wherein each layer 21 of shaped, non-planar paper material 22 (i) comprises shaped, non-planar paper 22, (ii) has an average paper layer thickness of from 0.1 millimeters (mm) to 5.0 mm, and (iii) has a paper layer density between 15 $g/m^3$ and 65 $g/m^3$.

9. The repulpable insulating liner 10 of claim 1, wherein each layer 21 of shaped, non-planar paper material 22 comprises at least 80% by weight of reclaimable paper pulp.

10. The repulpable insulating liner 10 of claim 1, wherein each layer 21 of shaped, non-planar paper material 22 comprises crepe paper, embossed paper, embossed tissue paper, or any combination thereof.

11. The repulpable insulating liner 10 of claim 1, wherein said repulpable insulating layer 20 has an overall thickness $t_1$ of from 0.25 inches (in) (6.35 mm) to 3.0 in (76.20 mm).

12. The repulpable insulating liner 10 of claim 1, wherein said repulpable insulating layer 20 has (i) an overall thickness $t_1$ of 0.5 in (12.70 mm), and (ii) an R-value equal to or greater than an R-value of a 1 lb per cubic foot density polyurethane foam insulating layer having a foam layer thickness of 1.0 in (25.40 mm).

13. The repulpable insulating liner 10 of claim 1, wherein the pliable first and second layers 11/12 each independently comprises a paper layer comprising at least 80% by weight of reclaimable paper pulp.

14. The repulpable insulating liner 10 of claim 1, wherein said first major outer liner surface 13 extends beyond said opening 15 to form a liner flap 110.

15. The repulpable insulating liner 10 of claim 14, wherein said liner flap 110 extends a length $F_L$ beyond said opening 15, and length $F_L$ is equal to or greater than a box form depth $D_{BF}$ of the repulpable insulating liner 10 when configured into a substantially rectangular box configuration 150.

16. The repulpable insulating liner 10 of claim 14, wherein said first insulating material end portion 26 extends into said liner flap 110.

17. The repulpable insulating liner 10 of claim 1, wherein said pliable first and second layers 11/12 are portions of a continuous recyclable and repulpable liner substrate (not shown) that is folded over onto itself to form (i) said first major outer liner surface 13, (ii) said second major outer liner surface 14 opposite said first major outer liner surface 13, (iii) said first major inner liner surface 16, and (iv) said second major inner liner surface 18 opposite said first major inner liner surface 16.

18. The repulpable insulating liner 10 of claim 1, further comprising: a liner closure 30 capable of at least partially closing said opening 15 of said liner 10.

19. An insulated shipping and storage container 100 comprising:

an outer box shipping and storage container 112 comprising at least a planar bottom wall 160, two sets of opposing planar side walls 161 and at least one top panel 162; and the repulpable insulating liner 10 of claim 1.

20. A method of maintaining an item at a desired temperature, said method comprising:

positioning the item within an insulated shipping and storage liner, the insulated shipping and storage liner comprises the repulpable insulating liner 10 of claim 1.

* * * * *